US006269911B1

(12) United States Patent
Richter

(10) Patent No.: US 6,269,911 B1
(45) Date of Patent: Aug. 7, 2001

(54) ELEVATOR INSTALLATION HAVING A CENTRAL CONTROL IN A REMOTE CENTRAL OPERATION CENTER

(75) Inventor: Lutz Richter, Berlin (DE)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/394,533

(22) Filed: Sep. 10, 1999

(30) Foreign Application Priority Data

Sep. 17, 1998 (EP) ..... 98810931

(51) Int. Cl.[7] ..... B66B 1/06

(52) U.S. Cl. ..... 187/289; 187/247; 187/382

(58) Field of Search ..... 187/289, 391, 187/393, 396, 382, 380, 390, 247

(56) References Cited

U.S. PATENT DOCUMENTS

| | | | | |
|---|---|---|---|---|
| 3,945,469 | * | 3/1976 | Dorcich | 187/29 |
| 4,401,192 | * | 8/1983 | Trosky et al. | 187/29 R |
| 4,709,788 | * | 12/1987 | Harada | 187/124 |
| 4,760,896 | * | 8/1988 | Yamaguchi | 187/124 |
| 4,771,865 | | 9/1988 | Hinderling . | |
| 4,860,207 | * | 8/1989 | Kubo | 187/124 |
| 4,947,965 | * | 8/1990 | Kuzunuki et al. | 187/127 |
| 5,010,472 | * | 4/1991 | Yoneda et al. | 187/391 |
| 5,398,782 | * | 3/1995 | Talbot et al. | 187/393 |
| 5,450,478 | | 9/1995 | Christy et al. . | |
| 5,557,546 | * | 9/1996 | Fukai et al. | 187/391 |
| 5,714,726 | * | 2/1998 | Ketoviita | 187/391 |
| 5,736,694 | | 4/1998 | Ketoviita . | |
| 5,889,239 | * | 3/1999 | Blackaby et al. | 187/391 |
| 6,082,500 | * | 7/2000 | Amo et al. | 187/391 |

FOREIGN PATENT DOCUMENTS

| | | | |
|---|---|---|---|
| 252 266 | | 1/1988 | (EP) . |
| 0780337 A2 | * | 6/1997 | (EP) . |
| 3-8679 | * | 3/1991 | (JP) . |
| 05338943 | * | 12/1993 | (JP) . |
| 211837 | * | 8/2000 | (JP) . |

* cited by examiner

*Primary Examiner*—Jonathan Salata
(74) *Attorney, Agent, or Firm*—Cohen, Pontani, Lieberman & Pavane

(57) ABSTRACT

In an elevator installation system of at least one elevator installation with one or more elevators and a service center, which is functionally connected therewith, but provided spatially separate therefrom, the control device of the elevator installation is likewise disposed in the service center. The control device stands in connection with the elevator installation by way of a data transmission device. Data for the control of the elevator installation are prepared in situ and transmitted either to the service center or to the control device, preferably by way of a public telephone network. After processing of the information in the service center, a return transmission of the ascertained control instructions and a corresponding actuation of the setting members and actuators for the operation of the elevators take place.

9 Claims, 4 Drawing Sheets

ELEVATOR INSTALLATION HAVING A CENTRAL CONTROL IN A REMOTE CENTRAL OPERATION CENTER

BACKGROUND OF THE INVENTION

1. Field of the Invention

The invention concerns a system and a method for the control of the operation of elevator installations.

2. Discussion of the Prior Art

For control of operation, each elevator installation is associated with control equipment, to which sensors and activators, such as, for example, operating, actuating and setting elements of the elevator installation, are connected. A microprocessor of the local control equipment reads the input signals and switches the output signals according to the provided control program. The processing of the signals and the statements, such as, for example, number of storeys, type of drive and so forth, which describe the elevator installation and are stored in the control, takes place in a microprocessor in situ at the elevator installation.

Elevator installation systems, the elevators of which are, apart from a conventional control equipment, equipped additionally with a modem for remote monitoring, have become known from European reference EP 0 252 266 B1 and U.S. Pat. No. 5,450,478. For this remote monitoring of elevator installations, the respective control equipment of each individual elevator installation communicates under certain conditions, by means of a modem by way of the public telephone network, with a central maintenance or service location. The data exchange provided in that case consists primarily of predefined diagnostic data with respect to operating state and events of interference and alarm at all elevator installations connected with the central maintenance or service location.

According to build-up and manner of function, the actual data exchange specific to the installation is preceded by a data exchange procedure which on the one hand builds up the communication channel and on the other hand regulates the access or the access authorization to data of the elevator control.

Although elevator installation systems equipped in this manner with a control system individual to an elevator together with modem enlargement and central maintenance and service location have proved themselves, they are nevertheless expensive in terms of apparatus by reason of their constructional and functional properties explained so far, and only a narrow selection of predefined reports can be transmitted to the maintenance and service center. The upkeep and the maintenance of the individual elevator installations, which are connected with the maintenance and service center and sometimes lie far apart in location in the overall system, become cost-intensive. Thereby, long waiting times arise in the case of operational disturbances of an elevator installation or of an elevator until the cause of the disturbance is ascertained at the location and the disturbance is eliminated.

SUMMARY OF THE INVENTION

It is therefore the object of the present invention to provide an installation system of the initially named kind, which makes possible a reduction of the operating means, a simplification of upkeep and maintenance as well as an enlargement of the service performances.

Pursuant to this object, and others which will become apparent hereafter, one aspect of the present invention resides in an elevator installation system having at least one elevator installation which includes at least one elevator. Control means are provided for controlling operation of the elevator. A service center is provided spatially separate from the elevator installation for monitoring operation of the installation. Data transmission means are provided for exchanging data relevant to an elevator between the elevator installation and the service center. The data transmission means includes a first transmission device arranged in the service center, a second transmission device arranged at the elevator installation, and a data path that connects the first transmission device with the second transmission device. The control means is arranged in the service center and data relevant to control of the elevator is transmissible reciprocally between the control means and the elevator installation by the data transmission means.

Another aspect of the invention resides in a method for controlling the operation of an elevator installation system, in which method data relevant to control of the elevators is transmitted via the data transmission means to the control means, which is arranged spatially separate from the elevators. The transmitted data is processed in the control means into control commands for the elevators. The control commands are transmitted from the service center by way of the data transmission means to the elevators for actuation of setting members such as a drive engine or a display at the elevator installation.

The essence of the invention consists in a remote control of elevators. For this purpose, a central control apparatus is connected with all elevators of an installation system by way of data transmission equipment. Control data and parameters are communicated between each elevator installation and the central control center, wherein the status of the sensors is processed into a control signal in the latter.

Advantages resulting from this consist in that only a single central control apparatus is required for all elevators of the entire system and the conventional controls at the elevator or elevators become superfluous. Thereby, the expenditure in terms of apparatus as well as also the building space, which is required each time at the building, at the elevator installation is reduced.

A central maintenance of this technique is possible in the case of transmission of all installation data and installation parameters to the central control apparatus of the overall system. Time-intensive and wage-intensive settings and adaptations in situ at the elevator become superfluous. By modifications of the software of the central control apparatus, elevator functions are influenced not only for individual elevators, but also for several elevators. Furthermore, it is possible to image a complete actual state of the elevator installation in the center and to correct data, which concern authorizations of use, travel destinations and so forth, at a central point.

Beyond that, completely flew forms of installation monitoring, preventive maintenance and servicing are possible with the elevator installation system according to the invention. Apart from the control algorithms, a separate evaluation of the transmitters can take place for an analysis of wear and failure. Each component group can be analysed preventively and evaluated statistically. Information about the installation can be made available in desired form to the client (for example Internet pages in place of lobby PC).

The various features of novelty which characterize the invention are pointed out with particularity in the claims annexed to an forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
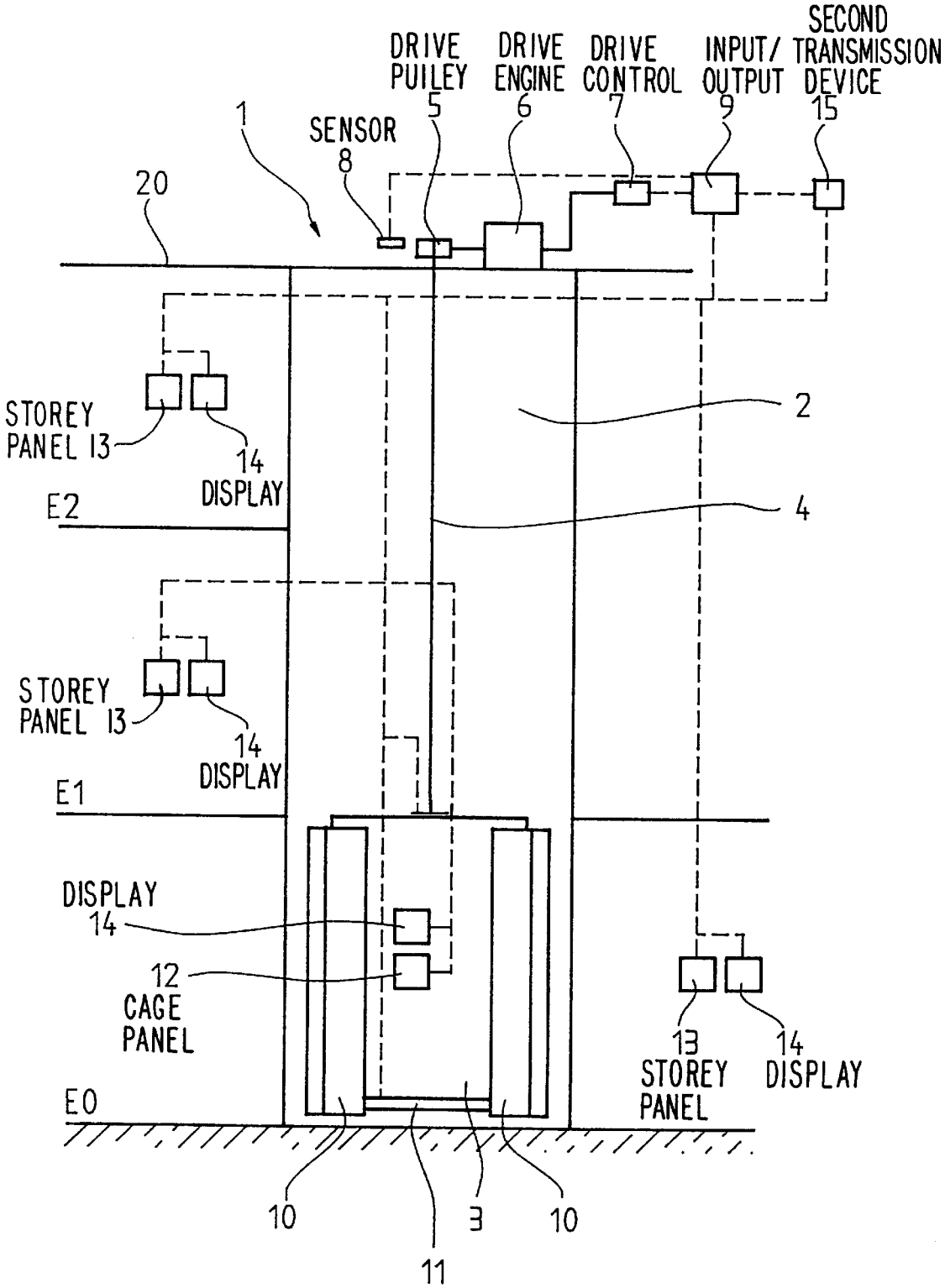
FIG. 1 shows a schematic illustration of a remotely controlled elevator installation.

An elevator installation 1, which comprises an elevator cage 3 movable in a shaft 2, is shown in FIG. 1. The elevator installation 1 can, as in this embodiment, be a single elevator or, however, also an installation with several elevators, which are interlinked in terms of control technique into one group, in a building. The elevator cage 3 is suspended at cables 4, which are guided over a drive pulley 5. The drive pulley 5 is set into motion by means of a drive engine 6, which is supplied with electrical energy by way of a drive control 7. For the monitoring of the movement of the drive pulley 5 and thus the position of the elevator cage 3 in the shaft 2, a sensor 8 is provided, the signal of which is fed to an input-output apparatus 9. The elevator cage 3 is closable by means of cage doors 10, which actuate not illustrated, parallelly running storey doors. A load-measuring device 11, for example a load-measuring floor, is provided for detection of the weight of the persons or goods situated in the elevator cage 3. A cage panel 12, by which the travel destinations are communicated to the input/output apparatus 9, is arranged in the elevator cage 3 according to FIG. 1. For the calling of the elevator cage 3, storey panels 13, which likewise stand in connection with the input/output apparatus 9, are provided on the storeys E0, E1 and E2. On each storey E0, E1 and E2 and in the elevator cage 3, a display device 14 is provided, with the aid of which information, such as, for example, the instantaneous position of the elevator cage 3, is communicated to the user. The input/output apparatus 9 is connected with a second transmission device 15. The signal lines are illustrated by broken lines.

As significant feature of the invention, all sensors and actuators necessary for the operation of the elevator installations 1 are each connected with the input/output apparatus 9. These data are transmitted, for processing, to a service center 16 in conventional manner by means of the second transmission device 15 by way of wireless or cable-bound media, such as optical or copper conductors, etc. In the case of the described embodiment, the elevator installations 1 and the service center 16 are connected together by way of the public telephone network 23.

Figure 2:
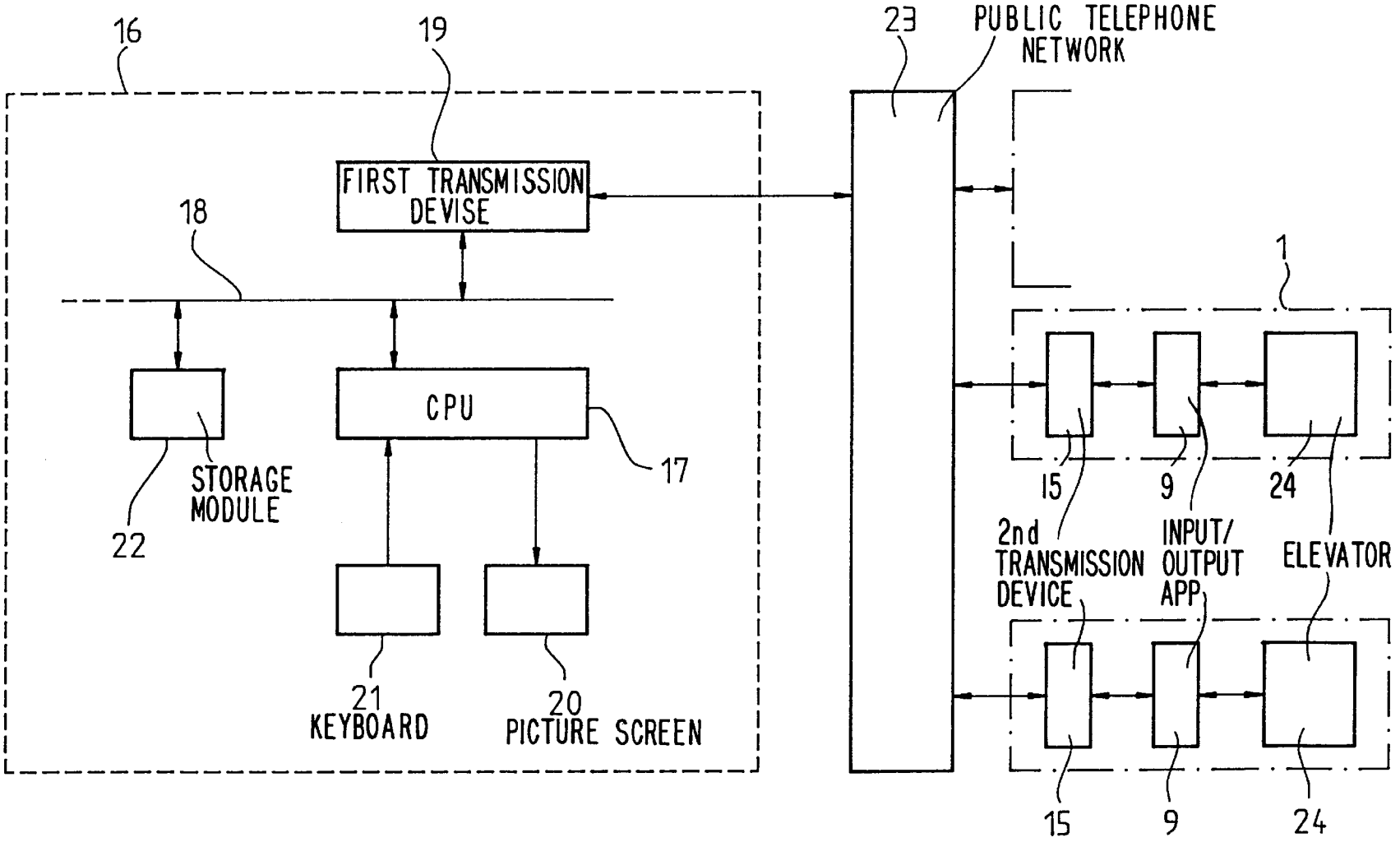
FIG. 2 shows a block diagram of a elevator installation system according to the invention.

FIG. 2 shows a block diagram of the elevator installation system with two elevator installations 1 and a service center 16, which controls and regulates the operation of the elevator installations 1 in dependence on the storey calls or a call from the elevator cage 3, and besides that monitors and records the maintenance state of the elevator installations 1. The service center 16 is composed of a computer system 17 with a keyboard 21 and a picture screen 20, a storage module 22, in which data relevant to maintenance and to operational state are filed, as well as a first transmission device 19, which are all connected by way of a data bus 18. By way of the data bus 18 and with the aid of additional data-processing equipment, the data filed in the data storage module 22 and/or actual operating data of the elevator installations 1 can be called up and processed further for additional evaluation.

The transmitted data are processed in the computer system 17 in the service center 16. The computer system 17 derives the setting commands for operation of the elevator installations 1 from the received data. These setting commands are then transmitted from the service center 16 to the elevator installations 1 with the aid of the first transmission device 19. The respective second transmission device 15 at each elevator installation 1 passes on the setting commands to the input/output apparatus 9. The input/output apparatus 9 controls the setting members or actuators, such as, for example, the drive engine 6 or the display device 14.

Figure 3:
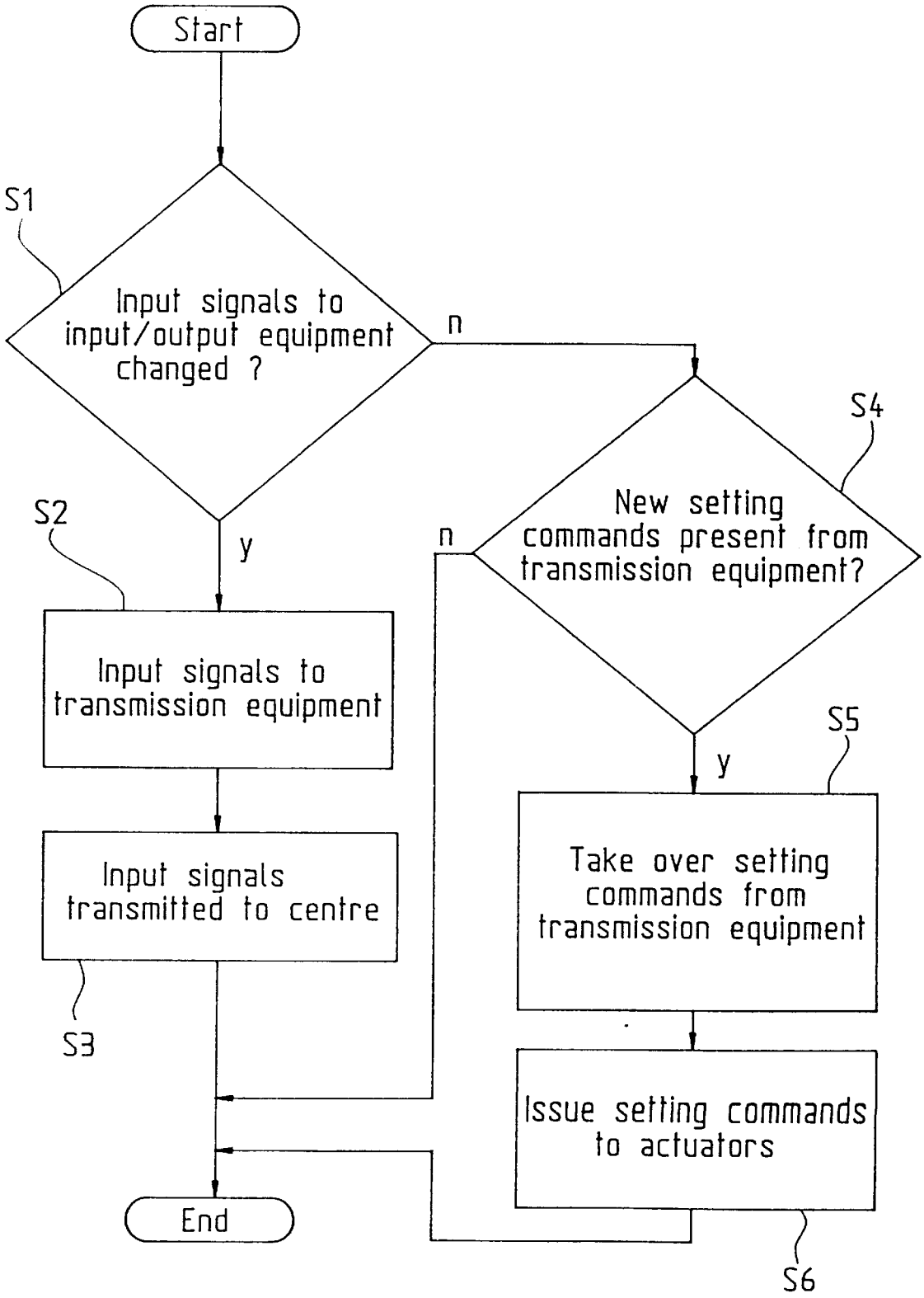
FIG. 3 shows a flow chart for illustration of the processing of the control data at the elevator installation.

FIG. 3 shows a now chart for illustration of the processing of the control data in the input/output apparatus 9 at the elevator installation 1. In step S1, it is checked whether the input signals at the input/output apparatus 9 have changed. In the case of a negative result denoted by n of the check, it is checked in step S4 whether new setting commands from the control center 16 have been received from the second transmission device 15. After a positive result denoted by y of the check, these setting commands are taken over by the input/output apparatus 9 from the second transmission device 15 in step S5. In the case of a result denoted by n of the check, a transmission error is present and the data transmission process is terminated. In step S6, the input/output apparatus 9 issues these setting commands to the actuators, for example the display device 14 or setting members, such as, for example, the drive control 7 or the drive engine 6 of the respective elevator installation 1.

If the step S1 is left by way of the positive result y, the changed input signals are transferred in step S2 from the input/output apparatus 9 to the second transmission device 15. In step S3, these signals are communicated by the second transmission device 15 to the service center 16.

Figure 4:
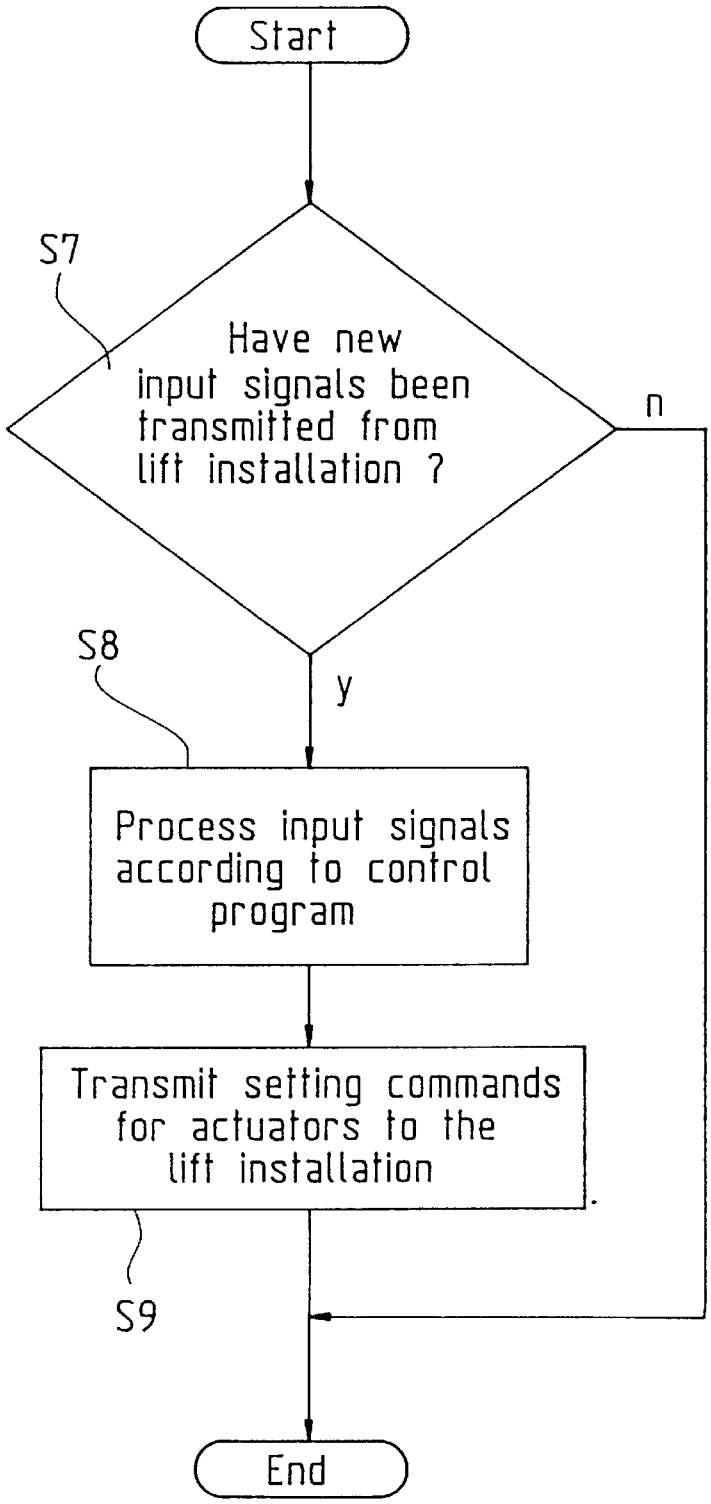
FIG. 4 shows a flow chart for illustration of the processing of the control data in the central control center.

FIG. 4 shows a flow chart for illustration of the processing of the control data in the service center 16. In step S7, it is checked whether flew input signals from the elevator installation 1 have been received in the computer system 17 of the service center 16 by way of the first transmission device 19. In the case of a positive result denoted by y of the check, the input signals are processed in step S8 by the control program stored in the computer system 17. In step S9, the setting commands, which were ascertained by the control program, for the setting members or actuators of the respective elevator 24 are transmitted with the aid of the first transmission device 19 to the corresponding elevator installation 1. If a negative result n results in step S7, the step S8 and S9 are bypassed.

The invention is not limited by the embodiments described above which are presented as examples only but can be modified in various ways within the scope of protection defined by the appended patent claims.

I claim:

1. An elevator installation system, comprising:

at least one elevator installation which includes at least one elevator;

control means for controlling operation of the elevator installation;

a service center which is spatially separate from the elevator installation for monitoring operation of the installation; and data transmission means for exchanging data relevant to an elevator between the elevator installation and the service center, the data transmission means including a first transmission device arranged in the service center, a second transmission device arranged at the elevator installation, and a data path arranged to connect the first transmission device with the second transmission device, the control means being arranged in the service center so that there is no elevator control at the elevator installation, and all data relevant to control technique are transmissible reciprocally between the control means and the elevator installation by the data transmission means.

2. An elevator installation system according to claim 1, wherein the control means is associated with several elevator installations.

3. An elevator installation system according to claim 1, wherein the data path is formed by optical conductors.

4. An elevator installation system according to claim 1, wherein the data path is formed by metallic conductors.

5. An elevator installation system according to claim 1, wherein the data path is a telephone network.

6. A method for controlling operation of an elevator installation system including at least one elevator installation which has at least one elevator, control means for controlling operation of the elevator installation, a service center which is spatially separate from the elevator installation for monitoring operation of the installation, the control means being located at the service center so that no elevator controls are at the elevator installation, and data transmission means for exchanging data relevant to an elevator between the elevator installation and the service center, the data transmission means including a first transmission device arranged in the service center, and a second transmission device arranged at the elevator installation, and a data path arranged to connect the first transmission device to the second transmission device, the method comprising the steps of:

transmitting data relevant to control of the elevators, via the data transmission means, to the control means which is spatially separate from the elevators;

processing the transmitted data in the control means into control commands for the elevators; and transmitting the control commands from the service center by way of the data transmission means to the elevators for actuating setting members.

7. A method for controlling the operation of an elevator installation system according to claim 6, including operating several elevators with one control means.

8. A method for controlling, the operation of an elevator installation system according to claim 6, wherein the transmitting step includes transmitting data relevant to control by wireless media.

9. A method for controlling the operation of an elevator installation system according to claim 6, wherein the transmitting step includes transmitting data relevant to control by cable-bound media.

* * * * *